US008191988B2

(12) United States Patent
Matsui et al.

(10) Patent No.: US 8,191,988 B2
(45) Date of Patent: Jun. 5, 2012

(54) LIQUID EJECTION HEAD, LIQUID-EJECTION HEAD SUBSTRATE, LIQUID EJECTING APPARATUS INCLUDING LIQUID EJECTION HEAD, AND METHOD OF CLEANING LIQUID EJECTION HEAD

(75) Inventors: Takahiro Matsui, Yokohama (JP); Yuzuru Ishida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 432 days.

(21) Appl. No.: 12/619,556

(22) Filed: Nov. 16, 2009

(65) Prior Publication Data

US 2010/0123759 A1 May 20, 2010

(30) Foreign Application Priority Data

Nov. 17, 2008 (JP) ..... 2008-293526

(51) Int. Cl.
*B41J 2/165* (2006.01)
*B41J 2/05* (2006.01)

(52) U.S. Cl. ..... 347/28; 347/63

(58) Field of Classification Search ..... 347/28, 347/63

See application file for complete search history.

(56) References Cited

U.S. PATENT DOCUMENTS

| | | | | |
|---|---|---|---|---|
| 2003/0103111 | A1* | 6/2003 | Saito et al. | 347/56 |
| 2007/0146428 | A1 | 6/2007 | Sakai | |
| 2009/0315954 | A1* | 12/2009 | Sakurai et al. | 347/63 |
| 2011/0310182 | A1* | 12/2011 | Mardilovich et al. | 347/56 |

* cited by examiner

*Primary Examiner* — Jerry Rahll
(74) *Attorney, Agent, or Firm* — Canon USA Inc IP Division

(57) ABSTRACT

A liquid ejection head includes a liquid-ejection head substrate including an element, which generates thermal energy used for ejecting a liquid from an ejection port, and a protective layer, which covers at least the element, and in which first layers and second layers are alternately stacked; a flow passage member which defines a wall of a flow passage communicating with the ejection port; and a flow-passage electrode disposed in the flow passage.

9 Claims, 7 Drawing Sheets

LIQUID EJECTION HEAD, LIQUID-EJECTION HEAD SUBSTRATE, LIQUID EJECTING APPARATUS INCLUDING LIQUID EJECTION HEAD, AND METHOD OF CLEANING LIQUID EJECTION HEAD

BACKGROUND OF THE INVENTION

1. Field of the Invention

The present invention relates to a liquid ejection head, a substrate for a liquid ejection head, a liquid ejecting apparatus including a liquid ejection head, and a method of cleaning a liquid ejection head.

2. Description of the Related Art

Recording methods using liquid ejection are methods of performing recording by ejecting a liquid (e.g., ink) from ejection ports provided in a liquid ejection head and allowing the liquid to adhere to a recording material such as paper. Among these recording methods, a liquid-ejection recording method in which a liquid is ejected by utilizing bubbling of the liquid formed by thermal energy generated by an electrothermal transducer can realize a high image quality and a high-speed recording.

A liquid ejection head typically includes a plurality of ejection ports, a flow passage communicating with the ejection ports, and a plurality of electrothermal transducers that generate thermal energy used for ejecting ink. Each of the electrothermal transducers includes a heating resistor layer, an electrode configured to supply the heating resistor layer with an electric power, and an insulating lower protective layer composed of, for example, silicon nitride and covering the heating resistor layer and the electrode. Thus, insulation is ensured between the ink and the electrothermal transducer.

A heating portion used as the electrothermal transducer during liquid ejection is exposed at high temperatures and undergoes a cavitation impact due to bubbling and contraction of a liquid and a chemical action due to ink in various manners. Therefore, in order to protect the heating resistor layer from such a cavitation impact and a chemical action due to the ink, an upper protective layer is provided on the heating portion. The temperature of a surface of the upper protective layer increases to about 700° C., and the surface contacts the ink. Accordingly, it is necessary that the upper protective layer have good film characteristics in terms of heat resistance, mechanical properties, chemical stability, alkali resistance, etc.

Furthermore, a coloring material, additives, and the like contained in the ink may be decomposed on the molecular level by heating at a high temperature and changed to a substance called "kogation", which is not readily dissolved. When such kogation is physically adsorbed on the upper protective layer, heat conduction from a heating resistor to the ink becomes nonuniform and thus formation of bubbles becomes unstable.

To solve this problem, US 2007/0146428 discloses a technique for removing kogation by dissolving a surface of an upper protective layer composed of iridium or ruthenium by an electrochemical reaction.

In the technique described in US 2007/0146428, the amount of reduction in the thickness of the upper protective layer due to the dissolution by the electrochemical reaction depends on the concentration of an electrolyte contained in ink used in the electrochemical reaction. Accordingly, it is a matter of concern that the amount of reduction in the thickness of the upper protective layer becomes variable because of a variation in the concentration of an electrolyte contained in ink or a variation in the type of ink. Such an uneven thickness of the upper protective layer in a head may degrade the recording quality. Accordingly, in a head in which a plurality types of ink having different colors are used, it is necessary to set conditions for an electrochemical reaction for each color. Furthermore, in some cases, the amount of dissolution of the upper protective layer may be larger than an assumed amount, and thus the electrochemical reaction cannot be conducted a predetermined number of times.

SUMMARY OF THE INVENTION

According to the present invention, even if a variation in an electrochemical reaction due to an electrolyte concentration or the like is present, the amount of thickness of a layer dissolved can be constant.

The present invention provides a liquid ejection head including a liquid-ejection head substrate including an element, which generates thermal energy used for ejecting a liquid from an ejection port, and a protective layer, which covers at least the element, and in which first layers and second layers are alternately stacked, a flow passage member which defines a wall of a flow passage communicating with the ejection port, and a flow-passage electrode disposed in the flow passage.

According to the present invention, in the case where an electrochemical reaction is generated on a protective layer (upper protective layer) as a kogation-removing operation, even if a variation in the electrochemical reaction due to an electrolyte concentration or the like is present, the amount of thickness of the protective layer dissolved by a single kogation-removing operation can be constant. Accordingly, a series of kogation-removing operations can be repeatedly performed with a high accuracy. As a result, a variation in the amount of reduction in the thickness of the protective layer in the head can be decreased. Consequently, ejection characteristics can be stabilized and thus reliable high-quality image recording can be performed.

Further features of the present invention will become apparent from the following description of exemplary embodiments with reference to the attached drawings.

DESCRIPTION OF THE EMBODIMENTS

In the present invention, an electrochemical reaction is generated by applying a voltage to a protective layer (upper protective layer), thereby removing kogation. A main feature of the present invention lies in that the upper protective layer has a stacked structure in which first layers serving as cleaning layers and second layers serving as cleaning stop layers are alternately stacked. A plurality of first layers and a plurality of second layers can be stacked. According to this structure, one of the cleaning layers which are the first layers is dissolved in the electrochemical reaction caused by a single kogation-removing operation, and one of the cleaning stop layers which are the second layers is then dissolved by subsequent ejection operations. These kogation-removing operation and ejection operations are repeatedly performed.

The present invention will now be described in detail with reference to the drawings.

1. Description of Substrate for Liquid Ejection Head and Liquid Ejection Head

Figure 1:
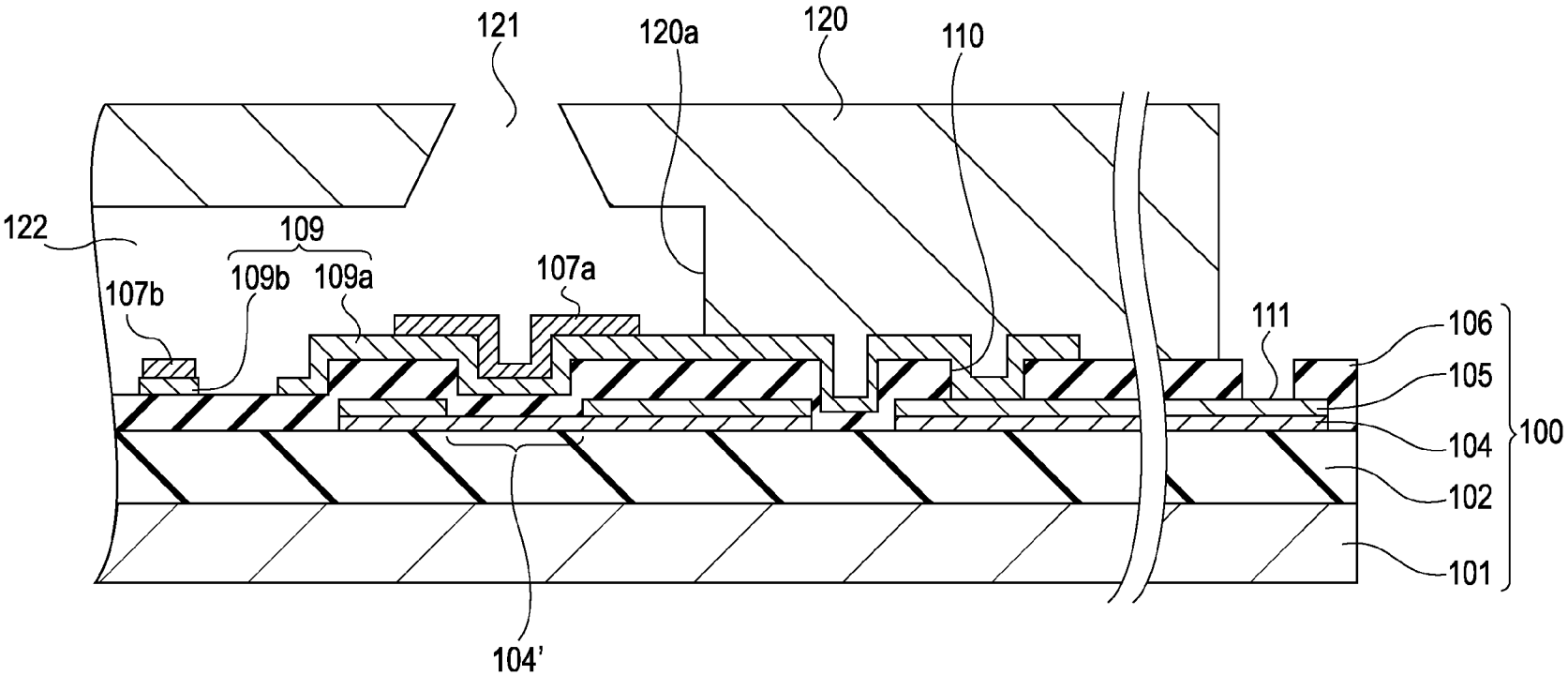
FIG. 1 is a schematic cross-sectional view of a substrate for a liquid ejection head according to an embodiment of the present invention.
Figure 2:
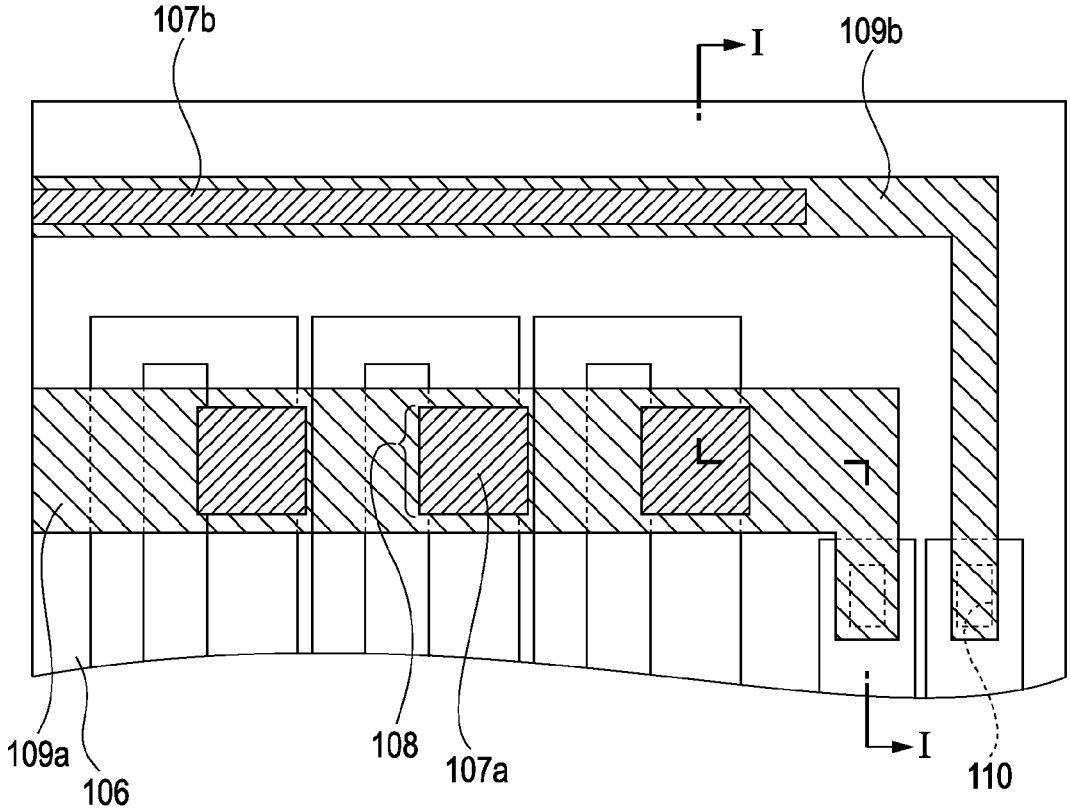
FIG. 2 is a schematic plan view near a heating portion of the substrate for a liquid ejection head according to the embodiment of the present invention.

FIG. 2 is a schematic plan view near a heating portion used as an electrothermal transducer of a substrate for a liquid ejection head (hereinafter referred to as "liquid-ejection head substrate") according to an embodiment of the present invention. FIG. 1 is a schematic cross-sectional view of the substrate vertically cut along line I-I in FIG. 2.

Referring to FIG. 1, a liquid-ejection head substrate 100 includes a base 101 composed of silicon, a heat storage or heat accumulating layer 102 composed of a thermally oxidized film, such as a SiO film, a SiN film, or the like, disposed on the base 101, and a heating resistor layer 104 disposed on the heat storage layer 102. A pair of electrode layers 105 each composed of a metal such as Al, Al—Si, or Al—Cu are disposed on the heating resistor layer 104 with a space therebetween. A lower protective layer 106 composed of a SiO film, a SiN film, or the like is provided on the electrode layers 105 and the heating resistor layer 104 located between the pair of electrode layers 105. The lower protective layer 106 also functions as an insulating layer. A heating portion 104' is composed of the heating resistor layer disposed between the electrode layers 105 and the lower protective layer 106 disposed thereon. A portion that applies heat generated by the heating portion 104' to ink constitutes a heat application portion 108 (as shown in FIG. 2). The electrode layers 105 are connected to a driver circuit or an external power supply terminal (not shown), and receive supply of an electric power from the outside. In an alternative configuration, the positions of the heating resistor layer 104 and the electrode layers 105 may be exchanged.

Adhesive layers 109*a* and 109*b* each composed of tantalum are provided on the lower protective layer 106. The adhesive layer 109*a* is disposed in a region including the upper portion of the heating portion 104'. The adhesive layer 109*b* is located separately from the adhesive layer 109*a* and disposed in a portion that contacts the ink in an ink flow passage 122.

An upper protective layer 107*a*, which is a feature of the present invention, is provided on a portion of the adhesive layer 109*a*, the portion corresponding to the heating portion 104'. The upper protective layer 107*a* protects the heating resistor from chemical and physical impacts due to heat generated from the ink and has a function of removing kogation in a cleaning process. In this embodiment, the upper protective layer 107 has a structure in which cleaning layers and cleaning stop layers are stacked.

A region of the upper protective layer 107*a* and a region of an upper protective layer 107*b*, which is used as an electrode in the flow passage (hereinafter referred to as "flow-passage electrode"), are not electrically connected to each other in the form of a substrate. However, when the flow passage is filled with a solution (ink) containing an electrolyte, a current flows through this solution. Accordingly, an electrochemical reaction is generated on an interface between the upper protective layer 107*a* and the solution and between the upper protective layer 107*b* and the solution.

In FIG. 1, in order to generate the electrochemical reaction between the upper protective layer 107*a* and the ink, a through-hole 110 is formed in the lower protective layer 106 so that the upper protective layer 107*a* is connected to the electrode layer 105 via the adhesive layer 109*a*. The electrode layer 105 extends to an end of the liquid-ejection head substrate 100, and an end of the electrode layer 105 forms an external electrode 111 for establishing an electrical connection to the outside.

The upper protective layer 107*a* corresponding to the heat application portion 108 is formed so that it is not in contact with a flow passage member 120. This is so that even when the upper protective layer 107*a* is dissolved by the electrochemical reaction, the adhesion between the flow passage member 120 and the substrate 100 is not decreased.

The structure described above relates to the liquid-ejection head substrate 100. An ejection port 121 is provided at a position corresponding to the heat application portion 108 of the liquid-ejection head substrate 100. Furthermore, the flow passage member 120 having a wall 120*a* of the flow passage 122 communicating from an ink supply port 705 penetrating through the liquid-ejection head substrate 100 to the ink ejection port 121 via the heat application portion 108 is brought into contact with the liquid-ejection head substrate 100 so that the wall 120*a* is disposed toward the inside, thereby forming the flow passage 122. Accordingly, a liquid ejection head 1 is formed.

Figure 6:
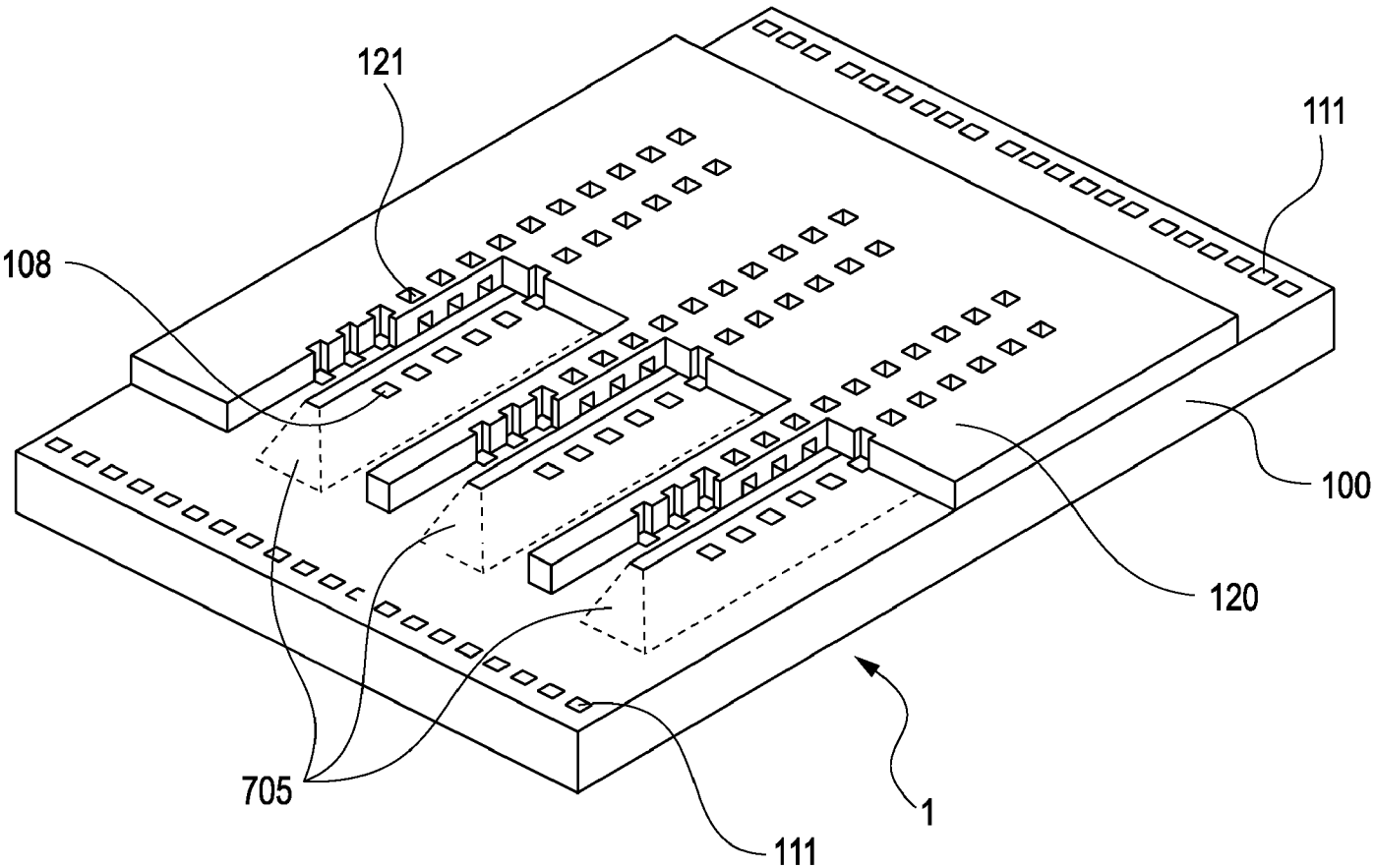
FIG. 6 is a perspective view showing a liquid ejection head according to an embodiment of the present invention.

FIG. 6 is a schematic perspective view of the above liquid ejection head 1.

The liquid ejection head 1 shown in FIG. 6 includes the liquid-ejection head substrate 100 having three ink supply ports 705 and can supply different types of ink to each supply port. A plurality of heat application portions 108 are provided in the longitudinal direction of both sides of each of the ink supply ports 705.

2. Structure and Operation of Upper Protective Layer

Figure 5:
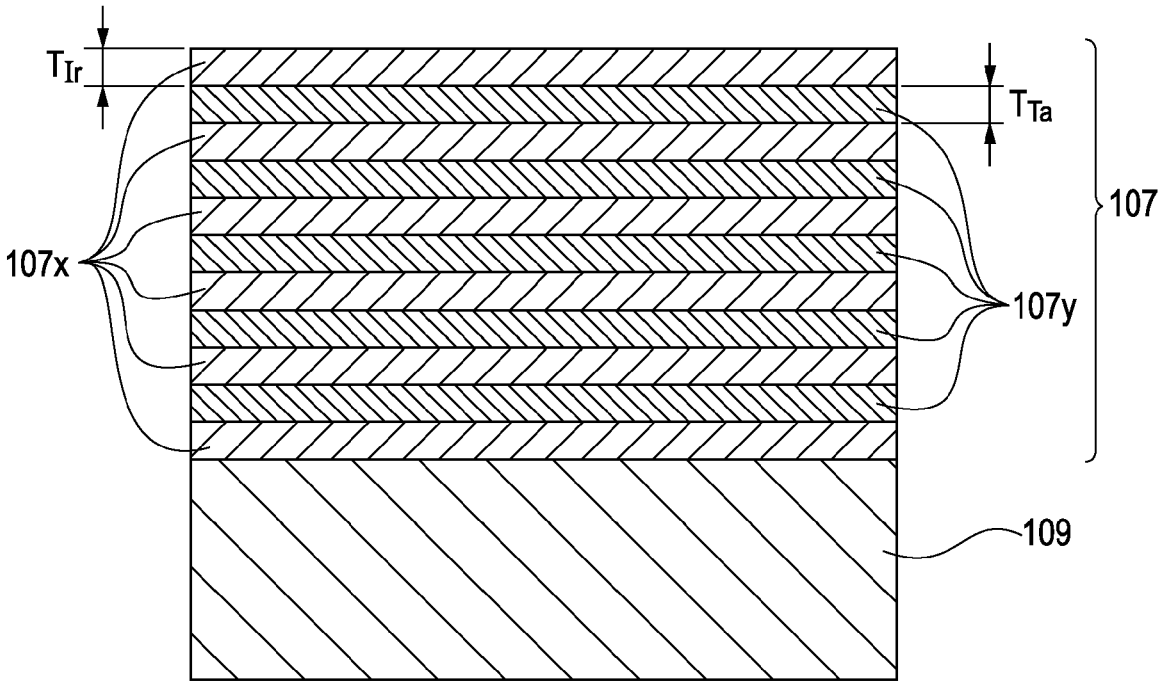
FIG. 5 is a schematic cross-sectional view near the heating portion when the substrate for a liquid ejection head according to the embodiment of the present invention is cut vertically.

The upper protective layer 107, which is a feature of the present invention, will now be described. FIG. 5 is an enlarged cross-sectional view of the upper protective layer 107*a* corresponding to the heat application portion 108 or the upper protective layer 107*b*. As shown in FIG. 5, the upper protective layer 107 has a structure in which cleaning layers 107*x* (first layers) and cleaning stop layers 107*y* (second layers) are alternately stacked.

As a material of the cleaning layers 107*x*, it is preferable to use a material which is dissolved in ink by an electrochemical reaction for a kogation-removing operation but which does not form an oxide film that obstructs the dissolution on heating, i.e. during normal recording operation. More specifically, a material containing at least one of iridium and ruthenium or a material composed of an alloy thereof can be used.

As a material of the cleaning stop layers 107*y*, it is possible to use a material which undergoes anode oxidization but is not dissolved in ink by an electrochemical reaction and which is dissolved in the ink by subsequent repeated ejection operations. Specifically, a material containing at least one of tantalum and niobium or a material composed of an alloy thereof can be used. The cleaning stop layers 107*y* can be composed of the same material as that of the adhesive layer 109 from the standpoint that adhesion with the cleaning layers 107*x* is ensured.

As the number of repetitions of the stacked structure of the cleaning layers 107*x* and the cleaning stop layers 107*y* increases, high-quality recording can be maintained for a long time. However, when the thickness of a film disposed on the heat application portion 108 is increased, energy necessary for ejection is also increased. Therefore, it is necessary to reduce the thicknesses of the cleaning layers 107*x* and the cleaning stop layers 107*y*. The thickness of the cleaning layers 107*x* and the cleaning stop layers 107*y* is preferably between 1 nm and 100 nm per layer, and the number of stacked layers (wherein one cleaning stop layer and one cleaning layer are counted as one stacked layer) is preferably between 2 and 100. This is based on the standpoint of energy necessary for ejection and the standpoint of the number of times cleaning can be performed using an electrochemical reaction, and thus advantages of energy saving and high-quality recording due to a repetition of cleaning can be achieved.

3. Description of Kogation-Removing Operation

In a kogation-removing operation in the present invention, an electrochemical reaction with ink which is a solution containing an electrolyte is generated using the upper protective layer 107*a*, corresponding to the heat application portion, as an anode electrode, and the upper protective layer 107*b* (flow-passage electrode) as a cathode electrode. In this case, the upper protective layer 107*a* is connected to the external electrode 111 via the region of the adhesive layer 109*a* and the electrode layer 105, and thus, a voltage is applied so that the upper protective layer 107*a* function as the anode. A cleaning layer 107*x* in the upper protective layer 107*a* which is the anode electrode dissolves, thereby removing kogation deposited on the protective layer. Metallic materials that are dissolved in the solution by the electrochemical reaction can be determined with reference to a potential-pH diagram of various metals. The material used as the cleaning layers 107*x* of the upper protective layer 107*a* in the present invention needs to be a material that does not dissolve at a pH value of the ink but dissolves when the upper protective layer 107*a* functions as the anode electrode by applying a voltage.

In addition, the top surface of the upper protective layer 107 is preferably a cleaning layer 107*x*. The reason for this is as follows. In the upper protective layer 107*b*, which functions as the cathode electrode, when the top layer is composed of a cleaning layer (iridium), the cleaning layer is not oxidized during ejection, and thus the stability of the upper protective layer 107*b* can be maintained as the cathode electrode. The upper protective layer 107*b* connected to the cathode side does not necessarily have a stacked structure. However, considering a production process including film deposition and etching, the upper protective layer 107*b* preferably has the same structure as that of the upper protective layer 107*a*.

By a single kogation-removing operation using an electrochemical reaction generated by the application of a voltage such that the upper protective layer functions as an anode, a single cleaning layer 107*x* exposed to the liquid (ink) is dissolved and the cleaning stop layer 107*y* below is exposed. The cleaning stop layer 107*y* exposed to the liquid (ink) is then passivated by being anodized by the continuing application of voltage such that the upper protective layer functions as an anode. The passivation forms an oxide layer which stops a reduction in the thickness of the upper protective layer 107 whilst the voltage is being applied such that the upper protective layer functions as an anode. In subsequent normal recording operations, the oxide film of the cleaning stop layer 107*y* exposed on the surface is gradually dissolved in the ink by repetitive heating of the heat application portion 108 during bubbling and ejecting of the ink or repetitive cavitation during debubbling after bubbling. Consequently, a new cleaning layer 107*x* is again exposed to the ink, and thus the kogation-removing operation can be repeatedly performed again.

As described above, by stacking the cleaning layers 107*x* and cleaning stop layers 107*y* having different properties in the upper protective layer 107, it is possible to control a reduction in the thickness of the layer in a single cleaning operation. Accordingly, even if the concentration of the electrolyte in the ink or a voltage applied during the electrochemical reaction varies, a reduction in the thickness of the film can be uniformly controlled, and kogation can be reliably removed.

Furthermore, for a liquid ejection head which includes a liquid-ejection head substrate having a plurality of ink supply ports and which ejects different types of ink, kogation-removing cleaning can be repeatedly performed for each color under a predetermined condition without individually setting a condition for an electrochemical reaction for each type of ink.

4. Description of Liquid Ejecting Apparatus

Figure 7:
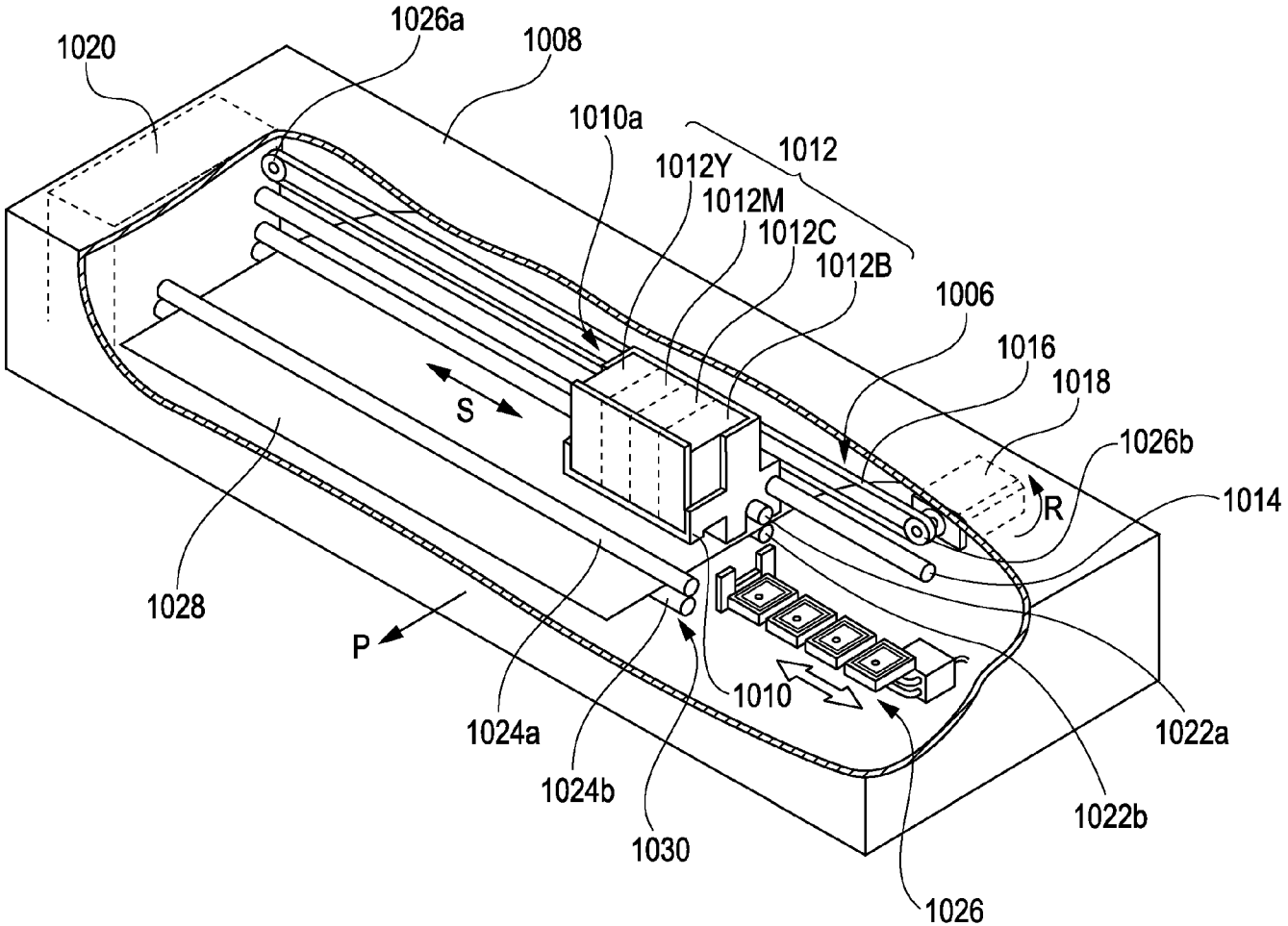
FIG. 7 is a perspective view showing an example of an outline structure of a liquid ejecting apparatus according to an embodiment of the present invention.

FIG. 7 is a schematic perspective view showing an example of the relevant part of a liquid ejecting apparatus (ink jet printer) according to this embodiment.

The liquid ejecting apparatus includes, in a casing 1008, a conveying device 1030 that intermittently conveys a sheet 1028, which is a recording medium, in a direction indicated by an arrow P. In addition, the liquid ejecting apparatus includes a recording unit 1010, which is reciprocated in a direction S that is perpendicular to a direction P in which the sheet 1028 is conveyed and in which a liquid ejection head is provided; and a movement driver 1006 serving as a driving unit configured to reciprocate the recording unit 1010.

The conveying device 1030 includes a pair of roller units 1022*a* and 1022*b* and a pair of roller units 1024*a* and 1024*b*, which are arranged parallel to and so as to face each other, and a driver 1020 that drives these roller units. When the driver 1020 is operated, the sheet 1028 is pinched by the roller units 1022*a* and 1022*b* and the roller units 1024*a* and 1024*b*, and is intermittently conveyed in the direction P.

The movement driver 1006 includes a belt 1016 and a motor 1018. The belt 1016 is wound around pulleys 1026*a* and 1026*b*, which are fitted on rotary shafts so that they face each other at a predetermined interval, and is positioned parallel to the roller units 1022*a* and 1022*b*. The motor 1018 moves the belt 1016 that is coupled with a carriage member 1010*a* of the recording unit 1010 in the forward direction and in the reverse direction.

When the motor 1018 is operated and the belt 1016 is rotated in a direction indicated by an arrow R, the carriage member 1010*a* moves a predetermined distance in the direction indicated by an arrow S. Furthermore, when the belt 1016 is rotated in a direction opposite to the direction indicated by the arrow R, the carriage member 1010*a* moves a predetermined distance in a direction opposite to the direction indicated by the arrow S. Furthermore, a recovery unit 1026 configured to perform an ejection recovery process for the recording unit 1010 is arranged at a position used as a home position of the carriage member 1010*a* so as to face an ink ejection surface of the recording unit 1010.

The recording unit 1010 includes cartridges 1012 that are detachably provided in the carriage member 1010*a*. For individual colors such as yellow, magenta, cyan and black, the cartridges 1012Y, 1012M, 1012C and 1012B are provided respectively.

EXAMPLES

Example 1

Example 1 of the present invention will now be described in detail with reference to the drawings.

FIGS. 3A to 3H are schematic cross-sectional views illustrating a process of producing the liquid-ejection head substrate shown in FIGS. 1 and 2. FIGS. 4A to 4H are schematic plan views corresponding to FIGS. 3A to 3H, respectively. Note that the following production process is performed for a substrate in which driving circuits, which are composed of semiconductor elements such as switching transistors for selectively driving the heating portion 104', have been provided in advance. However, for simplicity, a base 101 composed of silicon (Si) is shown in the figures described below.

First, a heat storage layer 102 composed of $SiO_2$ was formed as a lower layer of a heating resistor layer on the base 101 by a thermal oxidation method, a sputtering method, a CVD method, or the like. For a base in which driving circuits have been formed in advance, the heat storage layer can be formed during a production process of the driving circuits.

Next, a heating resistor layer 104 composed of, for example, TaSiN was formed on the heat storage layer 102 by reaction sputtering so as to have a thickness of about 50 nm. Furthermore, aluminum (Al) formed into an electrode layer 105 was deposited by sputtering so as to have a thickness of about 300 nm.

Figure 3A:
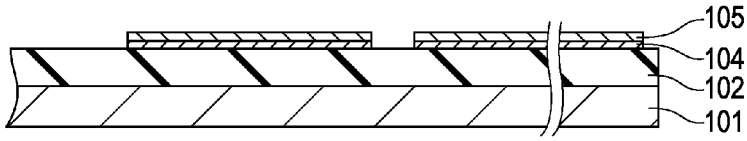
FIGS. 3A to 3H are schematic cross-sectional views illustrating a process of producing the substrate for a liquid ejection head shown in FIGS. 1 and 2.
Figure 4A:
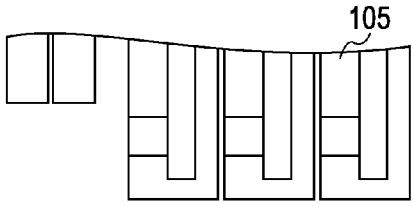
FIGS. 4A to 4H are schematic plan views corresponding to FIGS. 3A to 3H, respectively.

The heating resistor layer 104 and the electrode layer 105 were then dry-etched at the same time by a photolithography method to obtain the cross-sectional shape shown in FIG. 3A and the planar shape shown in FIG. 4A.

Figure 3B:
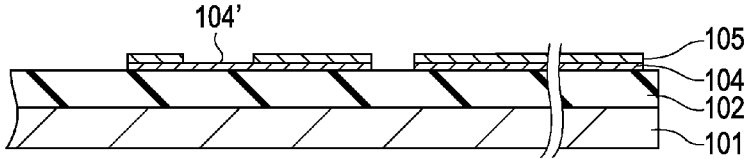
Figure 4B:
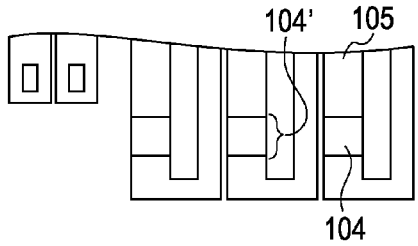

Next, as shown in FIGS. 3B and 4B, the Al electrode layer 105 was partly removed by wet-etching using a photolithography method again to expose part of the heating resistor layer 104 located at a position corresponding to the removed part. Thus, a heating portion 104' was provided. In order to obtain a satisfactory coverage property of a lower protective layer 106 at ends of the electrode layer, it is desirable to employ a known wet-etching technique, by which an appropriate tapered shape can be obtained at the ends of the electrode layer.

Figure 3C:
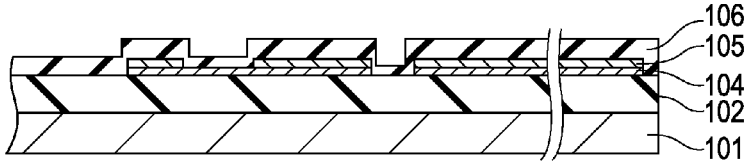
Figure 4C:
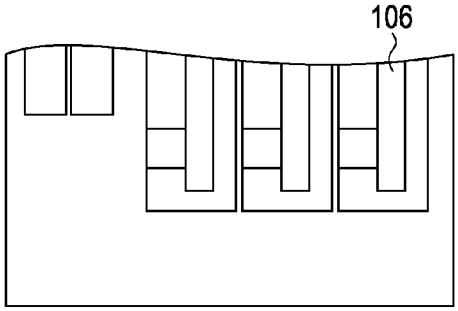

Subsequently, as shown in FIGS. 3C and 4C, SiN was deposited as the lower protective layer 106 by a plasma CVD method so as to have a thickness of about 350 nm.

Figure 3D:
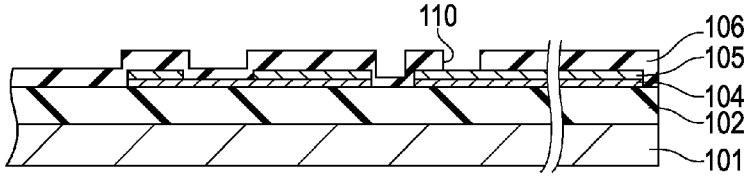
Figure 4D:
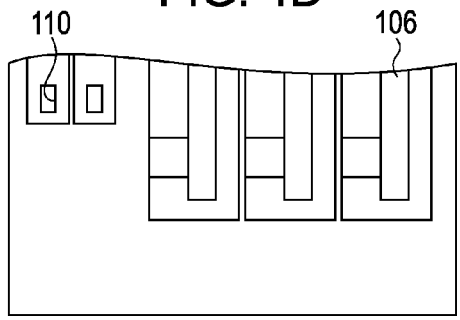

As shown in FIGS. 3D and 4D, the lower protective layer 106 was partly removed by dry-etching using a photolithography method to form a through-hole 110. The electrode layer 105 was thus exposed in the through-hole 110. This through-hole 110 ultimately provides an electrical connection between the electrode layer 105 and an upper protective layer 107 via an adhesive layer 109, formed on the lower protective layer 106.

Figure 3E:
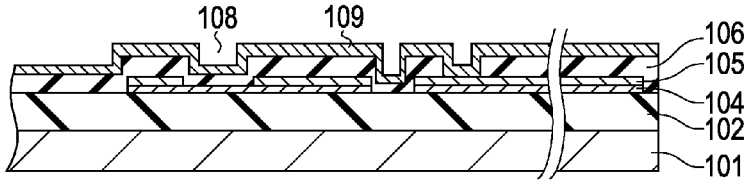
Figure 4E:
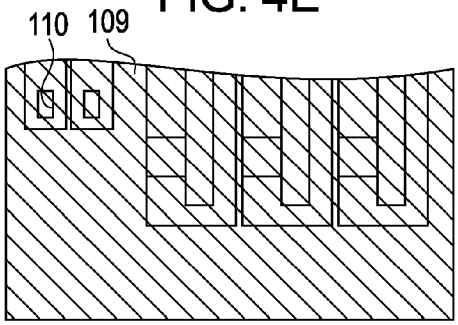

Next, as shown in FIGS. 3E and 4E, the adhesive layer 109 was formed on the lower protective layer 106 by sputtering tantalum (Ta) so as to have a thickness of about 100 nm. This adhesive layer 109 also functions as a wiring layer for supplying the upper protective layer 107 with an electric power in an electrochemical reaction.

Figure 3F:
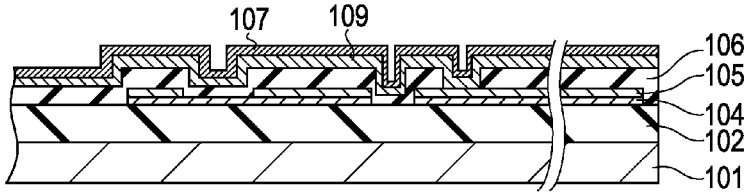
Figure 4F:
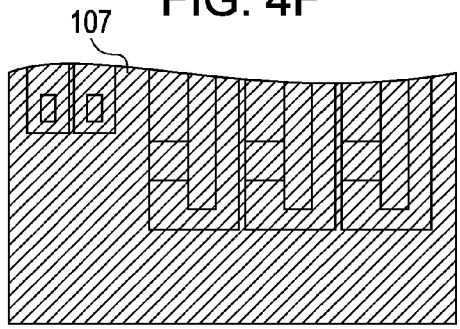

Next, the upper protective layer 107 shown in FIGS. 3F and 4F was formed. The upper protective layer 107 had a stacked structure formed by alternately forming a plurality of cleaning layers 107*x* and cleaning stop layers 107*y*, as shown in FIG. 5. First, on the surface of the adhesive layer 109, iridium constituting a cleaning layer 107*x* was deposited by a sputtering method so as to have a thickness of $T_{Ir}$. Subsequently, tantalum constituting a cleaning stop layer 107*y* was similarly deposited by a sputtering method so as to have a thickness of $T_{Ta}$. A series of these steps was repeated a plurality of times to form the upper protective layer 107 in which the cleaning layers 107*x* and the cleaning stop layers 107*y* were alternately stacked, as shown in FIG. 5. By forming the upper protective layer 107 using the sputtering method as described above, Ir films and Ta films containing Ir and Ta, respectively, in an amount in the range of about 90% to 100% can be provided. By providing such high-purity Ir films and Ta films in this manner, kogation can be efficiently removed.

In the formation of the upper protective layer 107 of this Example, the thickness $T_{Ir}$ of each of the cleaning layers 107*x* was about 10 nm, and the thickness $T_{Ta}$ of each of the cleaning stop layers 107*y* was about 10 nm. In addition, the above film deposition steps were repeated five times so that the total thickness of the upper protective layer including the cleaning layers 107*x* and the cleaning stop layers 107*y* was about 100 nm.

Figure 3G:
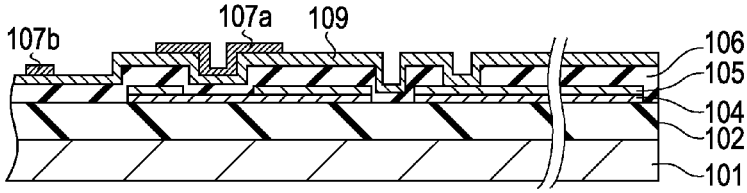
Figure 4G:
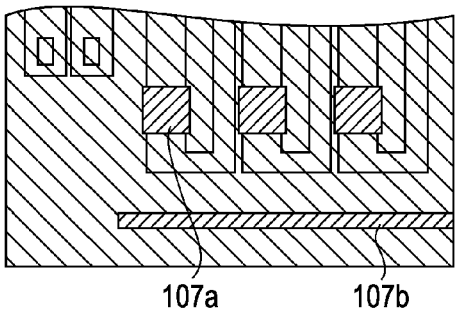

Next, in order to form a pattern of the upper protective layer 107 shown in FIGS. 3G and 4G, the upper protective layer 107 was partly removed by dry-etching using a photolithography method. Accordingly, a region of an upper protective layer 107*a* located on a heat application portion 108 and a region of an upper protective layer 107*b* were formed.

Figure 3H:
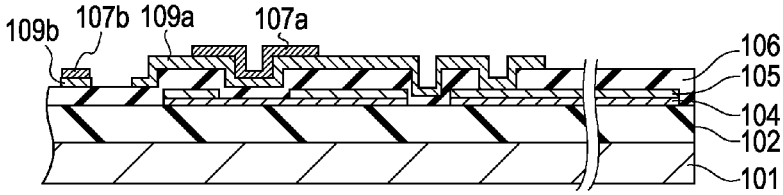
Figure 4H:
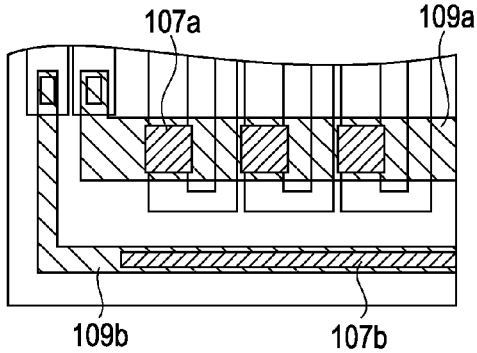

Next, in order to form a pattern of the adhesive layer 109 shown in FIGS. 3H and 4H, the adhesive layer 109 was partly removed by dry-etching using a photolithography method. Accordingly, a region of an adhesive layer 109*a* located on the heat application portion 108 and a region of an adhesive layer 109*b* were formed.

Next, in order to form an external electrode 111, the lower protective layer 106 was partly removed by dry-etching using a photolithography method to expose part of the electrode layer 105 located at a position corresponding to the removed part (not shown in the figure). A liquid-ejection head substrate 100 was produced by the above steps. A flow passage member 120 composed of a resin was formed on the liquid-ejection head substrate 100 using a photolithography technique to produce a liquid ejection head.

Evaluation of Heads and Comparative Example

In order to confirm an advantage of Example 1, a kogation removal experiment was conducted using a plurality of liquid ejection heads produced by the process described above and, as Comparative Example, a plurality of liquid ejection heads in which an upper protective layer 107 was composed of only iridium, the liquid ejection heads being disclosed in US 2007/0146428.

As for a layer structure of the heat application portion 108 in the liquid ejection heads of the Comparative Example, a bottom layer composed of tantalum and having a thickness of 150 nm was deposited as an adhesive layer 109, and iridium was then deposited as an upper protective layer 107 so as to have a thickness of 50 nm.

In the experiment, the heating portion 104' was driven under a predetermined condition so that kogation was deposited on the upper protective layer 107*a* corresponding to the heat application portion 108, and a kogation-removing process was then conducted by applying a voltage to the upper protective layer 107. In this experiment, the relationship between the amount of dissolution of an iridium film and the type of ink was examined. BCI-7eM and BCI-7eC. (manufactured by CANON KABUSHIKI KAISHA) were used as the ink.

First, drive pulses with a voltage of 20 V and a width of 1.5 μs were applied to the heating portion 104' $5.0\times10^7$ times with a frequency of 5 kHz. A surface state was then observed. According to the observation result, impurities in the ink, called kogation, was substantially uniformly deposited on the upper protective layer 107*a* corresponding to the heat application portion 108. When recording was performed using a liquid ejection head in such a state, ejection could not be performed at desired positions and it was confirmed that the recording quality was degraded.

Next, a DC voltage of 10 V was applied for 30 seconds to the external electrode 111 connected to the upper protective layer 107*a*. In this case, the upper protective layer 107*a* was used as an anode electrode and the upper protective layer 107*b* was used as a cathode electrode.

As a result, in each of the liquid ejection heads of Example 1 and the liquid ejection heads of the Comparative Example, it was confirmed that the deposited kogation was removed from the upper protective layer 107*a* (i.e., first layer) corresponding to the heat application portion when each type of ink was used.

Furthermore, regarding the liquid ejection heads of Example 1, in both the head in which the magenta ink was used and the head in which the cyan ink was used, one cleaning layer 107*x* which was disposed as the top layer of the upper protective layer 107*a* dissolved in the ink. It was confirmed that, consequently, a cleaning stop layer 107*y* disposed directly under the dissolved cleaning layer 107*x* appeared as the top layer. That is, it was confirmed that tantalum constituting the cleaning stop layer 107*y* was anodized by an electrochemical reaction with the ink and formed into a passivation film that did not dissolve in the ink, thereby stopping the reaction.

On the other hand, for each of the liquid ejection heads of the Comparative Example, a difference in the height between the upper protective layer 107*a* and the adhesive layer 109 was measured with a step profiler to determine the amount of decrease in the thickness of the upper protective layer 107*a*. According to the results, in the head in which the magenta ink was used, the reduction in the thickness of the layer was about 5 nm. In the head in which the cyan ink was used, the reduction in the thickness of the layer was about 8 nm. The reduction in the thickness of the layer varied by about 3 nm in a single electrochemical reaction depending on the type of ink.

Next, ejections of the ink were performed again so that kogation was deposited. In the liquid ejection head of Example 1, the cleaning stop layer 107*y* exposed on the top surface dissolved in the ink by an effect of, for example, cavitation due to an ejection operation and bubbling. Accordingly, the kogation was deposited on the surface of a second cleaning layer 107*x* disposed under the dissolved cleaning stop layer 107*y*.

Subsequently, this cleaning cycle in which the ink was ejected so that kogation was deposited and the kogation was then removed using an electrochemical reaction was repeated five times. The above-described surface observation and measurement of the amount of decrease in the film thickness were performed at the end.

It was confirmed that, regardless of the type of ink used, a single cleaning layer 107*x* was dissolved in the ink by a single electrochemical reaction, and a cleaning stop layer 107*y* appearing as the top layer was then dissolved in the ink by the ink ejection operation.

In contrast, in the liquid ejection heads of the Comparative Example, a difference in the thickness of the upper protective layer 107 was generated because of a difference in the electrochemical reaction related to different ink colors. In the head in which the magenta ink was used, the thickness of the remaining upper protective layer 107 was about 25 nm. On the other hand, in the head in which the cyan ink was used, the thickness of the remaining upper protective layer 107 was about 10 nm. In this manner, when the remaining film thickness of the heat application portion is different for each type of ink, in order to obtain a high recording quality, it is necessary to set energy required for ejection for each type of ink. As a specific example, an operation of setting the duration of drive pulses for each type of ink is necessary.

In contrast, when kogation-removing cleaning was conducted using the liquid ejection heads of Example 1, dissolution of the upper protective layer 107*a* could be performed very uniformly and with a good controllability even for different types of ink. Furthermore, it is easy to determine the thickness of the upper protective layer 107*a* disposed on the heat application portion 108. Accordingly, an initial recording quality can be maintained, and in addition, higher-quality recording with a good controllability of ejection energy can be realized.

Example 2

Example 2 of the present invention will now be described in detail with reference to the drawings.

In the sputtering method described in Example 1, atoms reaching a substrate are grown to form an island structure, and a plurality of islands are further combined to form a continuous film. When the thickness of a film is in the range of about 1 to 2 nm, the film may have an island structure or may be in an intermediate state between an island structure and a continuous film. Consequently, it is a matter of concern that a stacked structure of the upper protective layer cannot be uniformly formed with a high accuracy when the film thickness is around 1 to 2 nm. In particular, it may be difficult to control the quality of the layers at an interface between the upper protective layer 107 and the adhesive layer 109.

Consequently, in Example 2, the upper protective layer 107 was formed by employing an atomic layer deposition method in which a film was formed by repeatedly stacking atomic layers one by one. In the atomic layer deposition method, a substrate is placed in a vacuum chamber, molecules (precursor molecules) of a material to be deposited are adsorbed and reacted on a surface of the substrate, and excess molecules are removed by purging an inert gas. By repeating this cycle, the film thickness can be controlled on the atomic layer level. The resulting film is uniform and has a high covering property while having a very small thickness.

First, the base 101 shown in FIGS. 3E and 4E was formed as in Example 1 using CVD, sputtering, photolithography, and etching techniques. It is necessary that the adhesive layer 109, which also functions as a wiring layer for supplying an upper protective layer 107 with electric power in an electrochemical reaction, has a certain thickness. Accordingly, as in Example 1, tantalum was deposited as the adhesive layer 109 by sputtering so as to have a thickness of about 100 nm.

Subsequently, the upper protective layer 107 shown in FIG. 3F was formed. As in Example 1, iridium was used as the material of the cleaning layers 107*x*, and tantalum was used as the material of the cleaning stop layers 107*y*. In this Example, the upper protective layer 107 was formed by the atomic layer deposition method. First, first precursor molecules of iridium, which were a material of cleaning layers 107*x*, were introduced onto a surface of the base 101 and reacted on the surface of the adhesive layer 109, which had been formed on the surface of the base 101. Next, excess first precursor molecules were removed with an inert gas such as argon (Ar) gas. This step was repeated to stack atomic layers one by one, thus forming a cleaning layer 107*x* with a thickness of 2 nm. Subsequently, second precursor molecules of tantalum, which were a material of cleaning stop layers 107*y*, were introduced and reacted on the surface of the cleaning layer 107*x*. As in the above-described step, excess second precursor molecules were removed with an inert gas such as Ar gas to form a single tantalum atomic layer. This step was repeated to form a cleaning stop layer 107*y* with a thickness of 2 nm. These steps were repeated to form the upper protective layer 107 in which 25 cleaning layers 107*x* and 25 cleaning top layers 107*y*, i.e., 50 layers in total, were alternately stacked and which had a total thickness of 100 nm. By employing such an atomic layer deposition method, substantially impurity-free iridium cleaning layers 107*x* and tantalum cleaning stop layers 107*y* can be formed. By providing such high-purity iridium films and tantalum films in this manner, kogation can be efficiently removed.

According to this technique, the film quality can be uniformly controlled on the atomic layer level, and the resulting film has a high film quality while having a very small thickness. Therefore, the number of times stacking can be performed is increased. In addition, in a stepped portion such as a gap between electrode layers 105, a very high covering property can be obtained without increasing the film thickness.

Subsequent steps were performed as in Example 1. Therefore, a description thereof is omitted.

Evaluation of Heads

A kogation removal experiment was conducted using liquid ejection heads produced by the process described above to confirm an advantage of this Example.

In the experiment, as in Example 1, the heating portion 104' was driven under a predetermined condition so that kogation was deposited on the upper protective layer 107*a* corresponding to the heat application portion 108, and a kogation-removing process was then conducted by applying a voltage to the upper protective layer 107. In this experiment, BCI-7eM (manufactured by CANON KABUSHIKI KAISHA) was used as ink.

First, drive pulses with a voltage of 20 V and a width of 1.5 μs were applied to the heating portion 104' $5.0\times10^6$ times with a frequency of 5 kHz. Impurities in the ink, called kogation, was substantially uniformly deposited on the upper protective layer 107*a* corresponding to the heat application portion 108. When recording was performed using a liquid ejection head in such a state, it was confirmed that the recording quality was degraded because of the deposition of the kogation.

Next, a DC voltage of 10 V was applied for 30 seconds to the external electrode 111 connected to the upper protective layer 107*a*. In this case, the upper protective layer 107*a* was used as an anode electrode and the upper protective layer 107*b* was used as a cathode electrode.

This cycle of ejecting ink and cleaning kogation was repeated 25 times in total. In each cycle, a cleaning layer 107*x* of the upper protective layer 107 was dissolved in the ink by an electrochemical reaction. It was confirmed that a cleaning stop layer 107*y* disposed directly under the dissolved cleaning layer 107*x* was anodized, thereby stopping the electrochemical reaction. Furthermore, it was confirmed that the cleaning stop layer 107*y* was then dissolved by the subsequent ejection operations, and a cleaning layer 107*x* again appeared as the top layer.

As described above, according to the stacked structure of the upper protective layer 107 formed by the atomic layer deposition method, the thickness of a layer to be stacked is small. Accordingly, the number of repetitions of the stacked structure can be increased without increasing the total layer thickness compared to sputtered films. This structure can increase the number of times of the kogation-removing operation. Consequently, highly reliable printing with high quality can be performed for a long time as compared with the case where the upper protective layer 107 having the film quality obtained in Example 1 is used.

Other Examples

In the Examples described above, the thickness of the individual cleaning layers 107*x* is the same as the thickness of the individual cleaning stop layers 107*y*. Alternatively, each of the cleaning stop layers 107*y* may have a thickness larger than that of each of the cleaning layers 107*x*.

For example, a case where iridium is used as the cleaning layers 107*x* and tantalum is used as the cleaning stop layers 107*y* will be discussed. The thermal conductivity of iridium is about three times the thermal conductivity of tantalum. Therefore, when the thickness of each cleaning layer 107*x* is excessively large, thermal energy used for ejecting ink may not be sufficiently transmitted to the ink, thereby decreasing the ejection efficiency. Accordingly, as for the stacked structure of the upper protective layer 107, the thickness of the individual cleaning stop layers 107*y* is preferably between two and five times the thickness of the individual cleaning layers 107*x*. More specifically, the thickness of the individual cleaning stop layers 107*y* (tantalum layers) can be between 2 nm and 100 nm, and the thickness of the individual cleaning layers 107*x*(iridium layers) can be between 1 nm and 50 nm. In the atomic layer deposition method described in Example 2, by changing the number of repetitions of the atomic layer, a head including the cleaning stop layers 107*y* each having a thickness of 4 nm and cleaning layers 107*x* each having a thickness of 2 nm can be produced.

However, each of the cleaning stop layers 107*y* may have a thickness smaller than that of each of the cleaning layers 107*x*. This is because, by sufficiently decreasing the thickness of the cleaning stop layers 107*y*, dissolution of the cleaning stop layers 107*y* in the ink can be immediately performed. In such a case, since the cleaning stop layers 107*y* have a small thickness, the cleaning layers 107*x* should have a certain degree of thickness in order to function as the upper protective layer. That is, the thickness of the individual cleaning layers 107*x* is preferably between two times and ten times the thickness of the individual cleaning stop layers 107*y*. More specifically, the thickness of the individual cleaning layers 107*x* is preferably between 2 nm and 100 nm, and the thickness of the individual cleaning stop layers 107*y* can be between 1 nm and 10 nm.

According to the present invention, the individual cleaning stop layers 107*y* of the protective layer are not necessarily all composed of the same material. Similarly, the cleaning layers 107*x* are not necessarily all composed of the same material.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-293526 filed Nov. 17, 2008, which is hereby incorporated by reference herein in its entirety.

What is claimed is:

1. A liquid ejection head comprising:

a liquid-ejection head substrate including an element, which generates thermal energy used for ejecting a liquid from an ejection port, and a protective layer, which covers at least the element, and in which two or more first layers and two or more second layers are alternately stacked;

a flow passage member which has a wall of a flow passage communicating with the ejection port and which defines the flow passage by contacting the liquid-ejection head substrate so that the wall is disposed toward the inside; and a flow-passage electrode disposed in the flow passage, wherein in a case where a voltage is applied so that the protective layer functions as an anode electrode and the flow-passage electrode functions as a cathode electrode, a material of the first layers dissolves when in contact with the liquid and a material of the second layers is passivated when in contact with the liquid.

2. The liquid ejection head according to claim 1, wherein the first layers are composed of a material containing at least one of iridium and ruthenium.

3. The liquid ejection head according to claim 1, wherein the second layers are composed of a material containing at least one of tantalum and niobium.

4. The liquid ejection head according to claim 1, wherein the first layers and the second layers are each formed by an atomic layer deposition method.

5. The liquid ejection head according to claim 1, wherein the first layers and the second layers each have a thickness of 1 nm or more and 100 nm or less.

6. The liquid ejection head according to claim 1, wherein a thickness of each of the second layers is larger than a thickness of each of the first layers.

7. A liquid ejecting apparatus comprising:

the liquid ejection head according to claim 1; and a unit configured to apply a voltage between the protective layer and the flow-passage electrode.

8. A method of cleaning the liquid ejection head according to claim 1 comprising:

applying a voltage between the protective layer and the flow-passage electrode when one of the first layers is in contact with the liquid to dissolve the first layer and expose one of the second layers located directly under the first layer; and applying a voltage between the protective layer and the flow-passage electrode to passivate the exposed second layer.

9. A liquid-ejection head substrate comprising:

an element which generates thermal energy used for ejecting a liquid; and a protective layer which covers at least the element and in which two or more first layers and two or more second layers are alternately stacked, wherein in a case where a voltage is applied so that the protective layer functions as an anode electrode, a material of the first layers dissolves when in contact with the liquid and a material of the second layers is passivated when in contact with the liquid.

* * * * *